US008508464B2

(12) United States Patent
Liao et al.

(10) Patent No.: US 8,508,464 B2
(45) Date of Patent: Aug. 13, 2013

(54) BACKLIGHT CONTROL CIRCUIT CAPABLE OF DISTINGUISHING UNDER CURRENT CONDITION

(75) Inventors: Chiawei Liao, San Jose, CA (US); Xiaoyong Zhang, San Jose, CA (US); Jing-Meng Liu, Jubei (TW)

(73) Assignee: Richtek Technology Corporation, Chupei, Hsin-Chu (TW)

( * ) Notice: Subject to any disclaimer, the term of this patent is extended or adjusted under 35 U.S.C. 154(b) by 1518 days.

(21) Appl. No.: 12/008,797

(22) Filed: Jan. 14, 2008

(65) Prior Publication Data

US 2008/0180386 A1 Jul. 31, 2008

Related U.S. Application Data

(63) Continuation-in-part of application No. 11/906,477, filed on Oct. 2, 2007, now Pat. No. 8,035,606.

(30) Foreign Application Priority Data

Jan. 31, 2007 (TW) ..... 96103556 A

(51) Int. Cl.

| | |
|---|---|
| ***G09G 3/36*** | (2006.01) |
| ***G09G 5/00*** | (2006.01) |
| ***H05B 37/02*** | (2006.01) |
| ***H05B 37/00*** | (2006.01) |

(52) U.S. Cl.
USPC ..... 345/102; 345/211; 315/224; 315/291; 315/307; 315/312; 315/313

(58) Field of Classification Search
USPC ..... 345/102, 211; 315/224, 229–325
See application file for complete search history.

(56) References Cited

U.S. PATENT DOCUMENTS

| | | | | |
|---|---|---|---|---|
| 6,987,825 | B1 * | 1/2006 | Yoshimura et al. | 327/144 |
| 2004/0069962 | A1 * | 4/2004 | Hsu et al. | 250/580 |
| 2005/0104542 | A1 * | 5/2005 | Ito et al. | 315/291 |
| 2007/0085489 | A1 * | 4/2007 | Robinson et al. | 315/224 |
| 2007/0236265 | A1 * | 10/2007 | Maeda | 327/143 |
| 2007/0273681 | A1 * | 11/2007 | Mayell | 345/211 |

* cited by examiner

*Primary Examiner* — Bipin Shalwala
*Assistant Examiner* — Ryan A Lubit
(74) *Attorney, Agent, or Firm* — Tung & Associates

(57) ABSTRACT

The present invention discloses a backlight control circuit capable of distinguishing an under current condition, comprising: at least one light emission device path having a voltage node; at least one current source for controlling the current amount on the light emission device path; and at least one under current detection circuit for generating a first control signal according to the voltage at the voltage node, wherein when the first control signal changes its state, the under current detection circuit generates a second control signal to change the voltage on the voltage node if the light emission device path is normally connected.

35 Claims, 7 Drawing Sheets

BACKLIGHT CONTROL CIRCUIT CAPABLE OF DISTINGUISHING UNDER CURRENT CONDITION

RELATED APPLICATIONS

The present invention is a continuation-in-part application of U.S. Ser. No. 11/906,477, filed on Oct. 2, 2007.

FIELD OF INVENTION

The present invention relates to a backlight control circuit, more particularly, to a backlight control circuit capable of distinguishing under current condition even when the brightness of the light emitting devices is very low.

DESCRIPTION OF RELATED ART

In a liquid crystal display (LCD), a backlight control circuit is used which controls light emitting diodes (LEDs) to illuminate from the back side of an LCD screen, so that a user can observe an image from the front side of the LCD screen.

In early days, LED backlight is used only in a small size screen, which does not require high backlight brightness. Therefore, the LEDs can be connected all in series or all in parallel. FIG. 1 shows a conventional backlight control circuit with LEDs all connected in parallel. As shown in the figure, in a backlight control circuit 20, the currents passing through LEDs L1-LN are respectively controlled by the current sources CS1-CSN. The backlight control circuit 20 comprises a lowest voltage selection circuit 21 which chooses a lowest voltage value among all voltages at cathode ends of the LEDs L1-LN, and the error amplifier circuit 13 compares the lowest voltage value with a reference voltage Vref to generate a signal controlling the voltage supply circuit 11. Thus, the output voltage Vout is under control so that all current source circuits are provided with sufficient operating voltage for normal operation, and all LEDs can illuminate normally thereby.

The backlight control circuit 20 can further comprise an over voltage protection circuit to prevent the output voltage Vout from unlimitedly increasing. FIG. 2 shows a typical structure of an over voltage protection circuit 12, wherein the output voltage Vout is monitored by comparing the voltage at the node Vsense2 with a reference voltage Vovp. The result of comparison determines a signal for controlling the voltage supply circuit 11.

Because the backlight control circuit 20 is an integrated circuit, the number of its pins (shown by hollow squares in FIG. 1) is fixed. When the number of pins is larger than the number of LED strings to be connected with, prior art suggests connecting the excess pins to the output voltage Vout. An excess pin can not be left floating or grounded; otherwise the lowest voltage selection circuit 21 will select the input corresponding to it and keep increasing the output voltage Vout. By connecting the excess pin to the output voltage Vout, it can be sure that the lowest voltage selection circuit 21 will not select the input corresponding to the excess pin.

As the size of an LCD screen increases, the requirement for backlight brightness increases, and the number of LEDs correspondingly increases. Under such circumstance, it is impossible to connect all the LEDs in parallel; they have to be connected partially in series and partially in parallel, as shown in FIG. 3. In this case, the required output voltage Vout is much higher than that in FIG. 1; for example, the output voltage Vout in FIG. 1 may be around 5V, while the output voltage Vout in FIG. 3 may be as high as 60V. Accordingly, if any pin becomes an excess pin that has to be connected to the output voltage out, the device inside the integrated circuit in connection with the pin has to be a costly high voltage device. In addition, the electro-static damage issue will become worse, and the internal circuit will unnecessarily consume huge power and generate heat. Moreover, in either the prior art of FIG. 1 or FIG. 3, if any LED functions abnormally such as causing a corresponding path to be open, or a corresponding pin is caused to short to ground, the lowest voltage selection circuit 21 will select the input corresponding to it, and the error amplifier circuit 13 will keep asking the voltage supply circuit 11 to increase the output voltage Vout; the voltage supply circuit 11 can not adjust its output according to normal LEDs. In the case where an over voltage protection circuit is provided, the output voltage Vout will be kept at its upper limit, consuming huge power unnecessarily, while in the case where an over voltage protection circuit is not provided, the integrated circuit may be damaged due to continuously providing high power, and the LEDs may be burned out. To the above drawbacks and concerns, none of the prior art provides any solution.

In view of the foregoing, the U.S. Ser. No. 11/906,477, filed on Oct. 2, 2007 and assigned to the same assignee as that of the present invention, has proposed a solution wherein excess pins or corresponding LED paths can be shorted to ground or left floating. The application Ser. No. 11/906,477 discloses a circuit structure as shown in FIG. 4, wherein a backlight control circuit 30 comprises, in addition to a voltage supply circuit 11, an error amplifier circuit 13, and current sources CS1-CSN (illustrated by functional blocks), under current detection (UCD) circuits 31-3N. An example of the UCD circuit is shown in FIG. 5 (on the same page of FIG. 2). The UCD circuits 31-3N detect whether an "under current condition", i.e., an "abnormally low current" or "no current" condition occurs in a corresponding LED path 101-10N. (An LED path 101-10N is a path from the node of the output voltage Vout to ground.) When there is no "low current" or "no current" condition, the UCD circuits 31-3N will forward the voltage signals on the LED paths 101-10N to the corresponding voltage comparison paths 111-11N, so that the lowest voltage selection circuit 21 can receive these signals. When an under current condition occurs in one or more LED paths 101-10N, the corresponding UCD circuits 31-3N exclude corresponding voltage comparison paths 111-11N paths from valid inputs of the lowest voltage selection circuit 21, that is, the lowest voltage selection circuit 21 will not accept any voltage signal from such voltage comparison paths 111-11N.

Although the solution provided by U.S. Ser. No. 11/906,477 has properly solved the problems in prior art, certain product applications requires adjusting the backlight brightness of an LCD. In this case, when the brightness of LEDs is lower than a certain limit, i.e., when the current amount on a corresponding LED path is below a certain threshold, an UCD circuit 31-3N may fail to distinguish between the under current condition and the normally low current condition.

SUMMARY

In view of the foregoing, it is therefore an objective of the present invention to provide a backlight control circuit capable of distinguishing under current condition even when the brightness of the light emitting devices is very low, to solve the problems in prior art. The backlight control circuit of the present invention is compatible with dimming control for the light emitting devices.

It is another objective of the present invention to provide a light emitting device path status detection method.

It is a further objective of the present invention to provide an under current detection circuit.

In accordance with the foregoing and other objectives, and from one aspect of the present invention, a backlight control circuit comprises: at least one light emission device path having a voltage node; at least one current source for controlling the current amount on the light emission device path; and at least one under current detection circuit for generating a first control signal according to the voltage at the voltage node, wherein when the first control signal changes its state, the under current detection circuit generates a second control signal to change the voltage on the voltage node if the light emission device path is normally connected.

In another aspect of the present invention, a light emitting device path status detection method comprises: A light emitting device path status detection method, comprising: providing at least one light emission device path having a voltage node; generating a first control signal according to the voltage on the voltage node; and when the first control signal changes its state, changing the voltage at the voltage node if the light emission device path is normally connected.

In yet another aspect of the present invention, an under current detection circuit comprising: a comparator for generating a control signal by comparing a node voltage with a reference voltage; a pulse generator for generating a pulse according to the control signal; and a node voltage adjustment circuit for adjusting the node voltage according to the pulse.

In this invention, preferably, the node voltage may be changed by dropping the current on the light emission device path, so that the node voltage bounces up.

These and other features, aspects, and advantages of the present invention will become better understood with reference to the following description of preferred embodiments and accompanying drawings.

DESCRIPTION OF THE PREFERRED EMBODIMENTS

Figure 1:
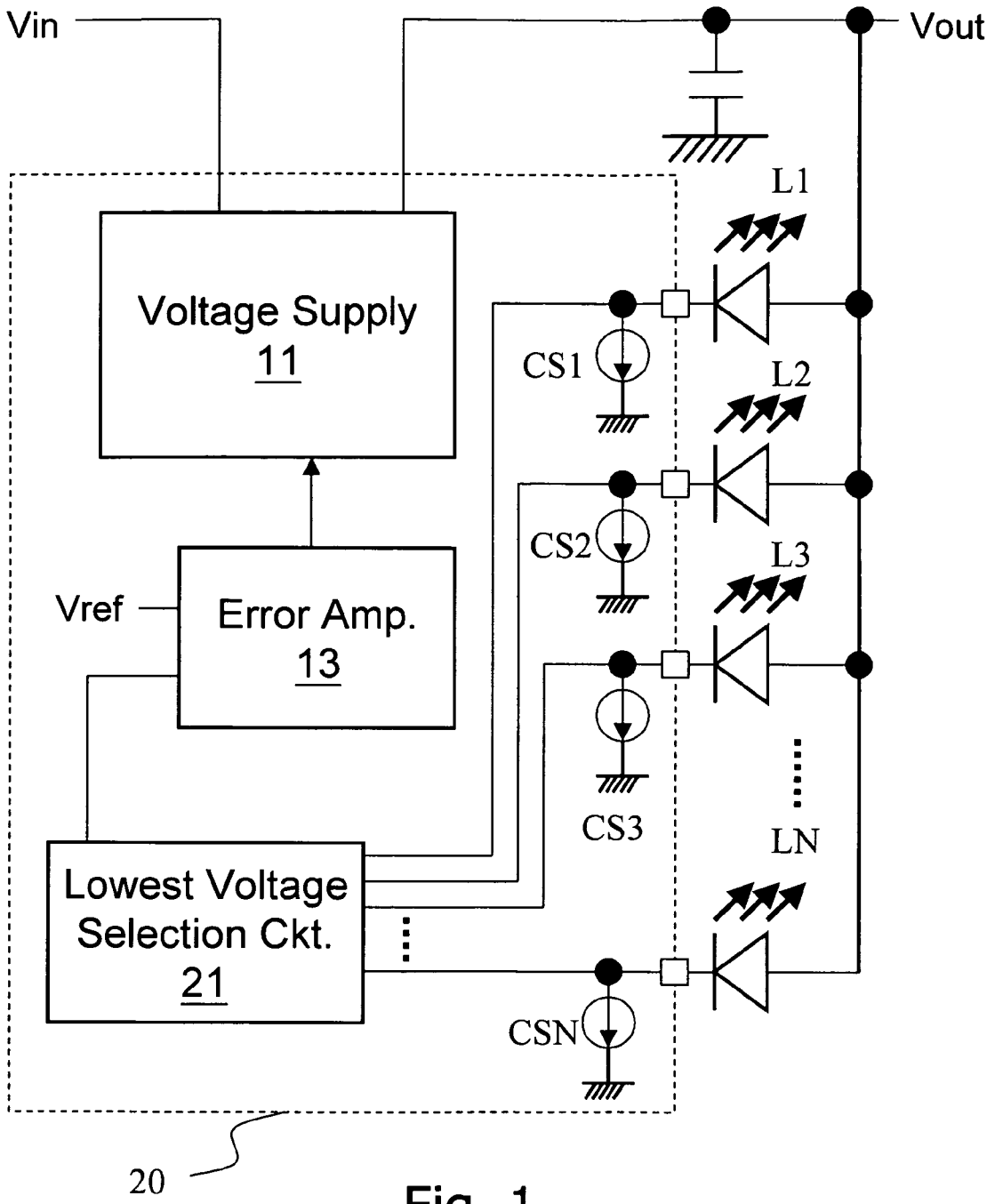
Fig. 1 (Prior Art)
FIG. 1 is a schematic circuit diagram showing a prior art circuit including LEDs which are all connected in parallel and a backlight control circuit thereof.
Figure 2:
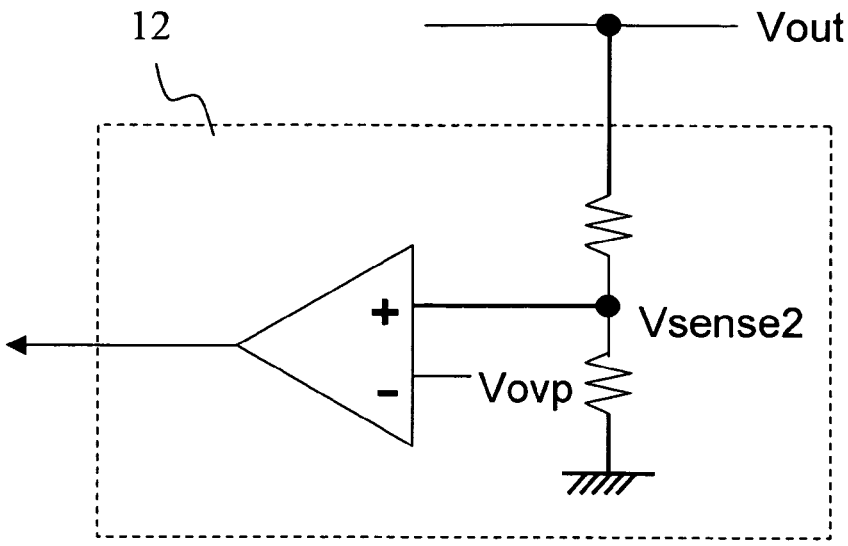
Fig. 2 (Prior Art)
FIG. 2 is a schematic circuit diagram showing a conventional over voltage protection circuit.
Figure 5:
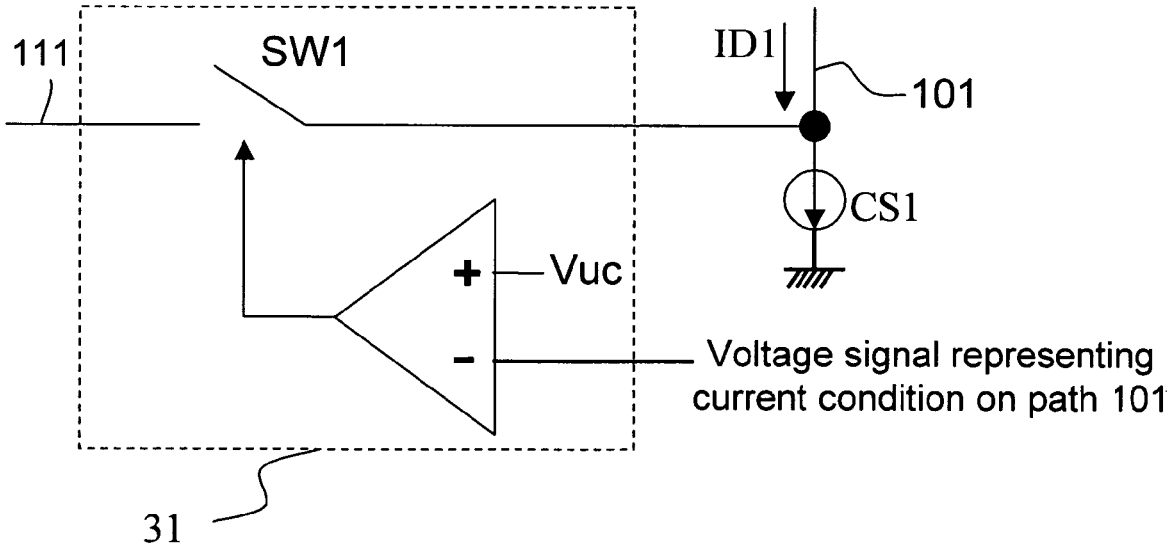
FIG. 5 is a schematic circuit diagram showing an example of the UCD circuit of FIG. 4.
Figure 3:
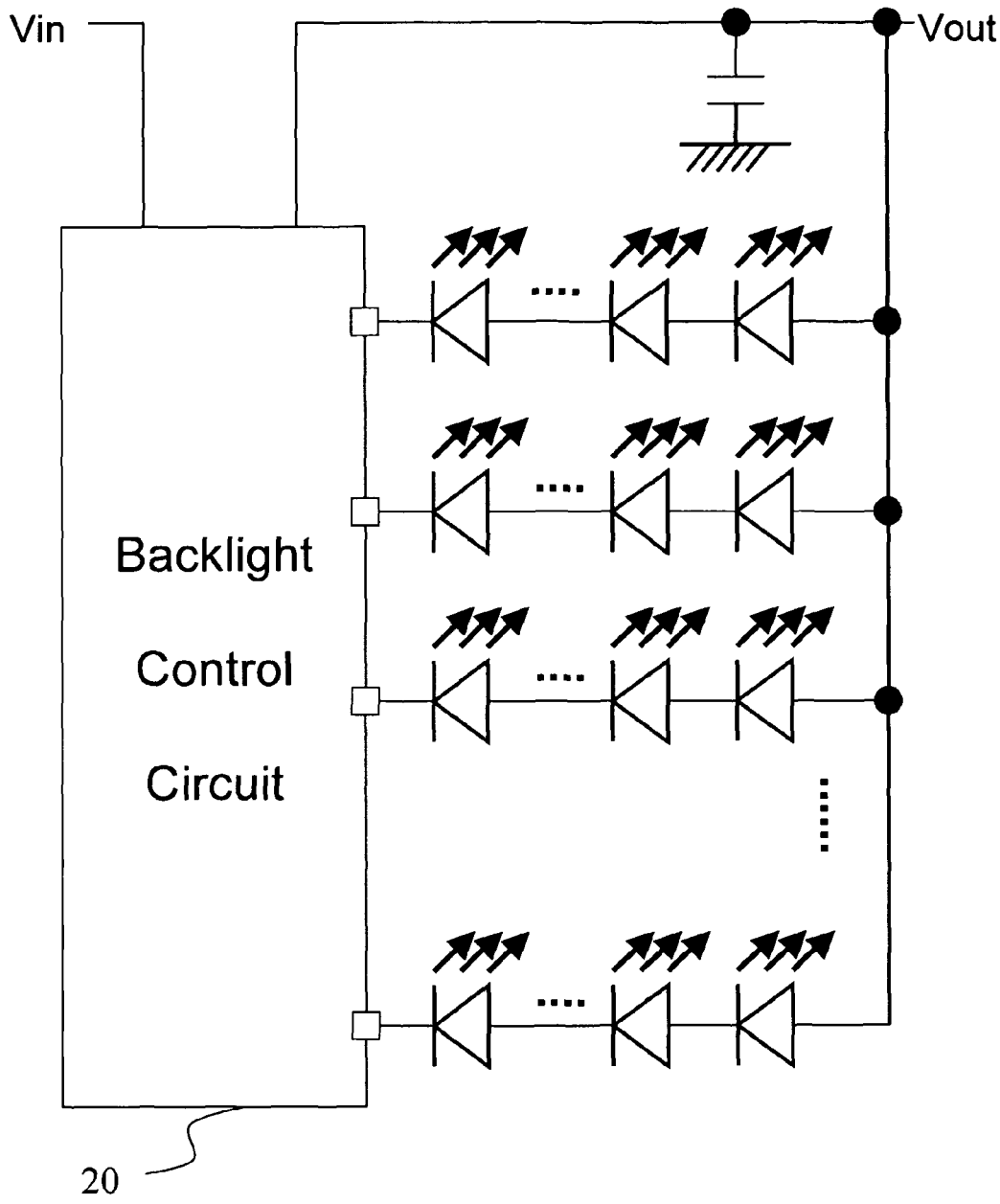
Fig. 3 (Prior Art)
FIG. 3 is a schematic circuit diagram showing a prior art circuit including LEDs which are connected partially in series and partially in parallel, and a backlight control circuit thereof.
Figure 4:
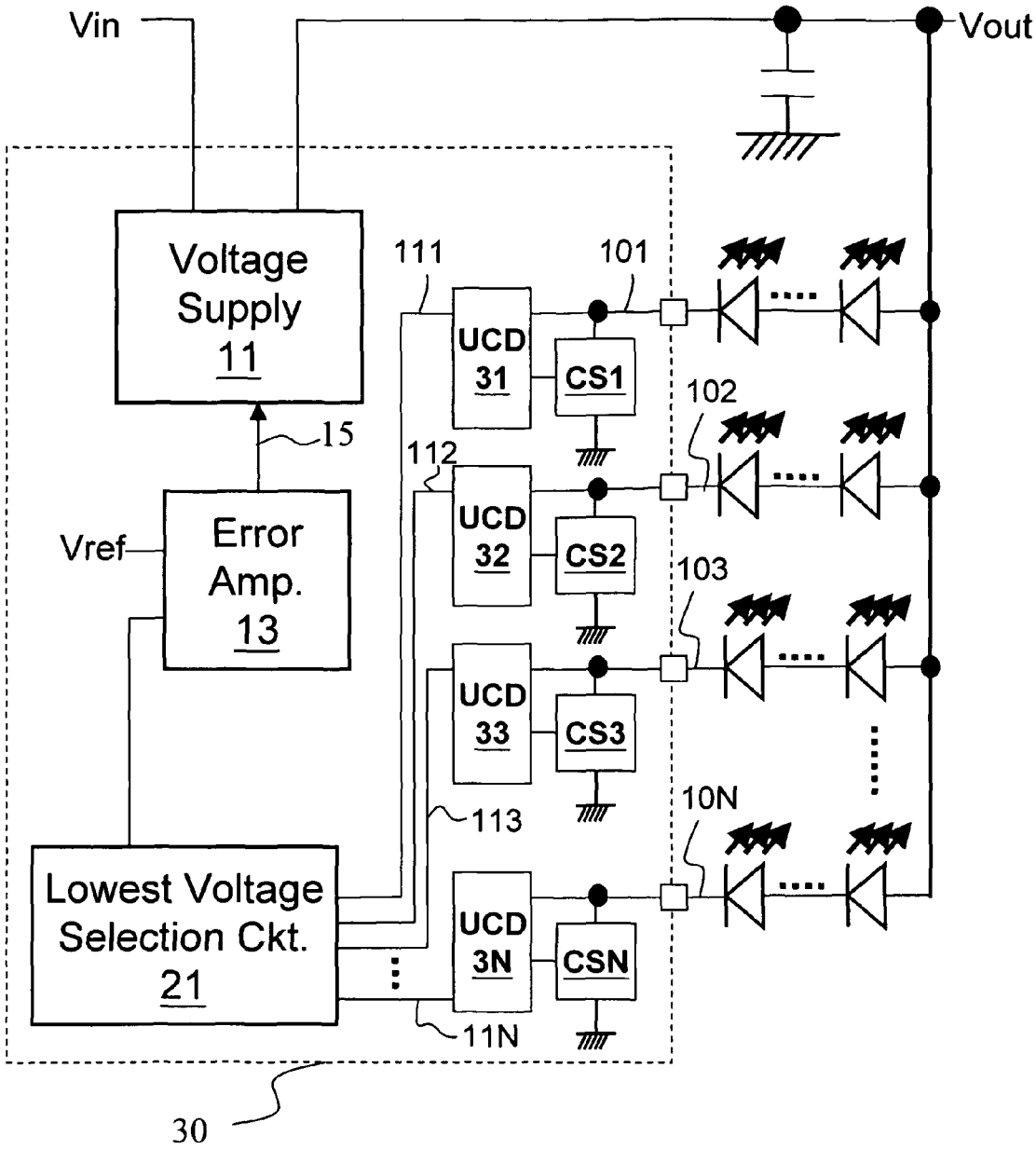
FIG. 4 is a schematic circuit diagram showing a backlight control circuit including UCD circuits, which has been assigned to the same assignee as that of the present invention.
Figure 6:
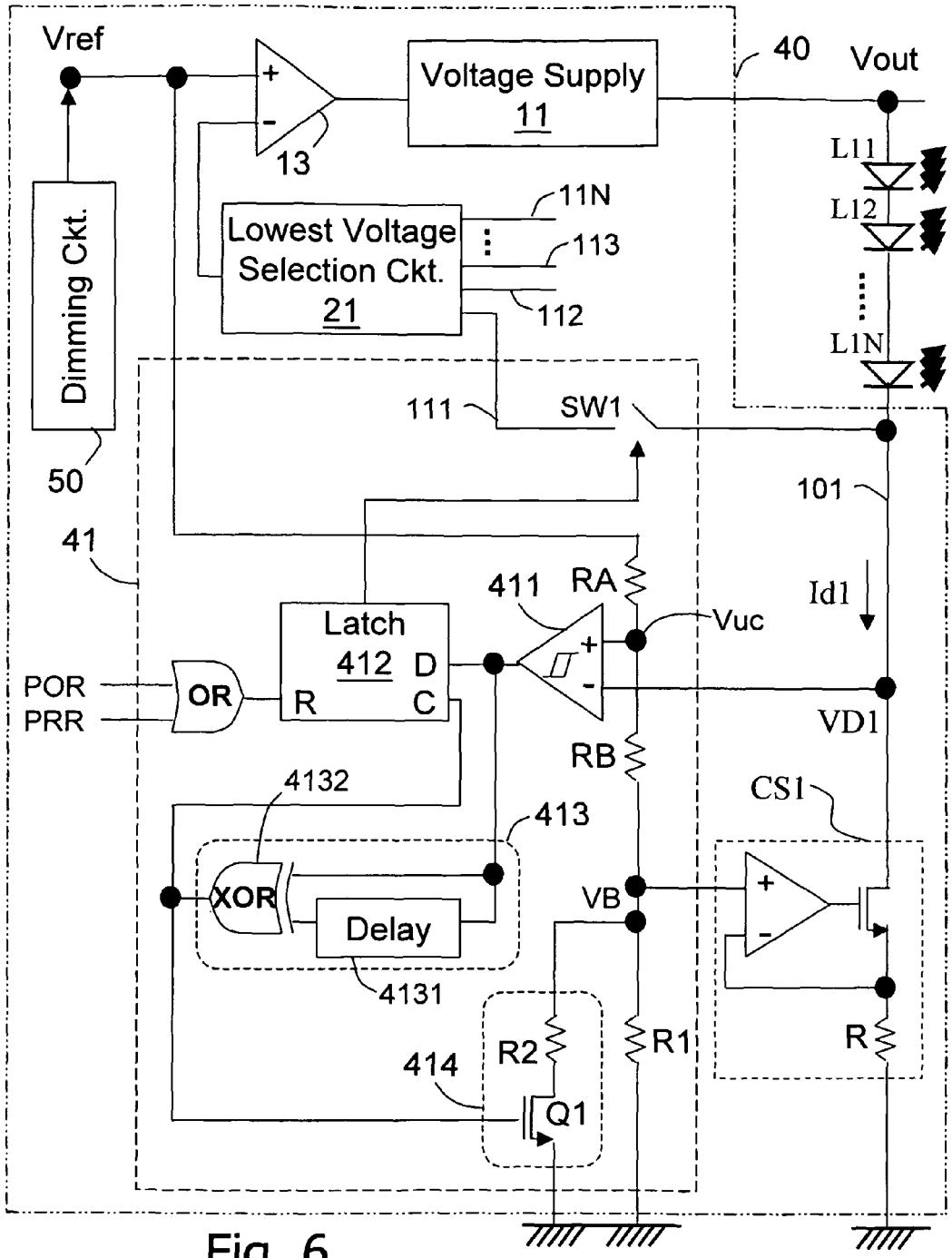
FIG. 6 is a schematic circuit diagram showing a backlight control circuit according to an embodiment of the present invention.

FIG. 6 is a schematic circuit diagram showing a backlight control circuit according to an embodiment of the present invention. For simplicity, only one LED path 101 is illustrated in the figure; however, in a real case, the number of the LED paths may be more than one (denoted by N, N being a positive integer). In the backlight control circuit 40 of this embodiment, the reference voltage Vref of the error amplifier circuit 13 is controlled by a dimming circuit 50, for adjusting the brightness of the LEDs. The backlight control circuit 40 also includes UCD circuit 41-4N (but only UCD circuit 41 is shown in this figure).

As shown in the figure, the UCD circuit 41 includes a comparator 411, a latch 412, a pulse generator 413, and a voltage drop circuit 414. These devices operate as below. The comparator 411 compares the voltage at the node VD1 with the reference voltage Vuc, to determine whether the switch SW1 should be closed or opened. During normal operation, the voltage at the node VD1 is higher than the reference voltage Vuc, so the output of the comparator 411 is at low level. The comparator 411 may be a general comparator or a hysteresis comparator (as shown) for better signal judgment. The output of the comparator 411, which is preferably stored in the latch 412, controls the switch SW1, to close it in normal operation. Of course, depending on how the switch SW1 is designed, the output of the comparator 411 may have to be inversed.

On the other hand, if an LED path is open due to malfunction, not in use, or other reasons, the voltage at the node VD1 would be lower than the reference voltage Vuc, and the output of the comparator 411 becomes high, to open the switch SW1.

When the output of the comparator 411 maintains at either the low level or the high level, it does not affect the pulse generator 413. However, when the output of the comparator 411 changes state, either from low to high or from high to low, the state switching will cause the pulse generator 413 to generate a pulse. The output level switching of the comparator 411 means that the interrelationship between the voltage at the node VD1 and the reference voltage Vuc changes. This may happen in several occasions: in the initialization stage; due to state change in the connection of the corresponding LED path (because of malfunction or manually changing the connection state); in a transient state due to manually adjusting the LED brightness too low; or simply by a transient misoperation of the circuit. If the reference voltage Vref is set at a low value, the voltage at the node VD1 is very close to the reference voltage Vuc, and therefore a transient signal in any part of the circuit may very possibly cause the output of the comparator 411 to change state. No prior art has proposed any solution to this issue; here the present invention provides the solution, which is to verify the accuracy of the state change by the circuit shown in the figure. According to the present invention, in one embodiment, verification can be made every time when a state change occurs in any LED path.

As an example, the pulse generator 413 may be embodied as shown in the figure. When the output of the comparator 411 changes state, because of the operation of a delay circuit 4131, an XOR gate 4132 generates a positive pulse. The positive pulse temporarily turns ON the switch Q1 in a voltage drop circuit 414, forming a parallel-connection circuit of resistors R1 and R2 to decrease the total resistance. Hence, the voltage at the node VB drops (temporarily). In normal operation, the decrease of the voltage at the node VB causes the current Id1 on the path 101 to decrease. Correspondingly, the voltage drop of the LEDs L11-L1N decreases; however, the output voltage Vout does not change at this instant period, so the voltage at the node VD1 (equal to the output voltage Vout minus the total voltage drop of the LEDs L11-L1N) will bounce up at this instant period. On the contrary, if the LED path 101 is open due to malfunction, not in use, or other reasons, the voltage at the node VD1 will keep unchanged, i.e., still lower than the reference voltage Vuc. Thus, by the pulse from the pulse generator 413, the voltage at the node VD1 will have two distinctly different states in normal and abnormal operations, and more distinguishable.

After the pulse ends, the output of the comparator 411 will be kept in the latch 412 with the correct level, to ensure that the switch SW1 receives the correct signal. In one embodiment, the output of the pulse generator 413 is sent to the latch 412 as its clock signal so that the latch 412 updates its data according to the clock and stores the final data at the end of the clock. In this way, the latch 412 stores the correct data for controlling the switch SW1.

Note that the reference voltages Vref and Vuc are illustrated to be connected in series, and a resistor RA is provided therebetween. This is to imply the functional relationship Vref>Vuc between the reference voltages Vref and Vuc. However, it does not mean that these two reference voltages have to be connected in the way shown in the figure. For example, the resistor RA may be replaced by another voltage source, or the reference voltages Vref and Vuc may be set individually.

Similarly, the reference voltages Vref and VB are illustrated to be connected in series, and resistors RA and RB are provided therebetween. This is to imply the functional relationship between the reference voltages Vref and VB, so that the dimming control (adjusting the brightness of the LEDs by adjusting the current on the LED path) may be achieved by adjusting the reference voltage Vref. However, it does not mean that these two reference voltages have to be connected in the way shown in the figure. The resistors RA and RB may be replaced by other voltage sources, or the reference voltages Vref and VB may be set individually. Moreover, the relationship Vuc>VB shown in the figure is not always true; in fact, the reference voltages Vuc and VB are independent from each other.

In the case where the latch 412 is employed, its content may be uncertain during power ON or power recovery stage. To be prudential, in one embodiment, the latch 412 may optionally be reset by a power ON reset signal POR or a power recovery reset signal PRR.

Figure 7:
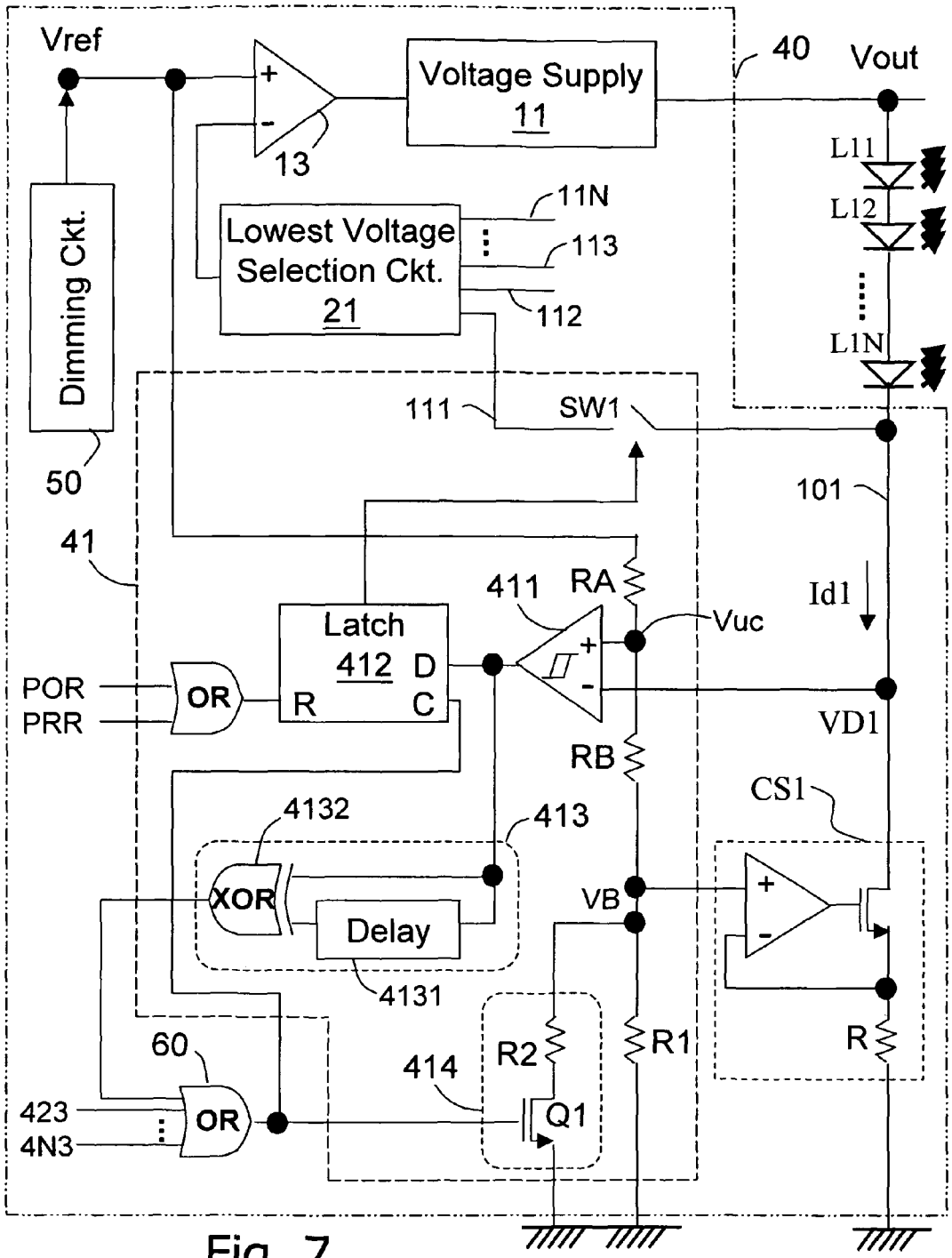
FIG. 7 is a schematic circuit diagram showing a backlight control circuit according to another embodiment of the present invention.

Referring to FIG. 7, in a more prudential embodiment, it can be arranged so that when any node VD1-VDN in any of the LED paths changes its relative position with respect to the reference voltage Vuc (i.e., when any one of the pulse generators generates a pulse), the conditions of all of the LED paths are verified. As shown in the figure, the outputs of the pulse generator 413 and the other pulse generators 423-4N3 (the UCD circuits 42-4N are not shown in the figure; the pulse generator 423 is the pulse generator in the UCD circuit 42, the pulse generator 4N3 is the pulse generator in the UCD circuit 4N, and so on) are subject to logic operation in a logic circuit 60, whose output controls the switch Q1 in the voltage drop circuit 414. In this embodiment, the logic circuit 60 is an OR gate, meaning that as long as one of the pulse generators 413-4N3 generates a pulse, the voltage drop circuit 414 will be enabled and the current source CS1 will decrease the current on the path 101, so that the comparator 411 is more capable of distinguishing the difference between its two inputs. The output of the logic circuit 60 is not only provided to the voltage drop circuit 414 but also provided to the voltage drop circuits and latches in the other UCD circuits 42-4N (not shown).

Figure 8:
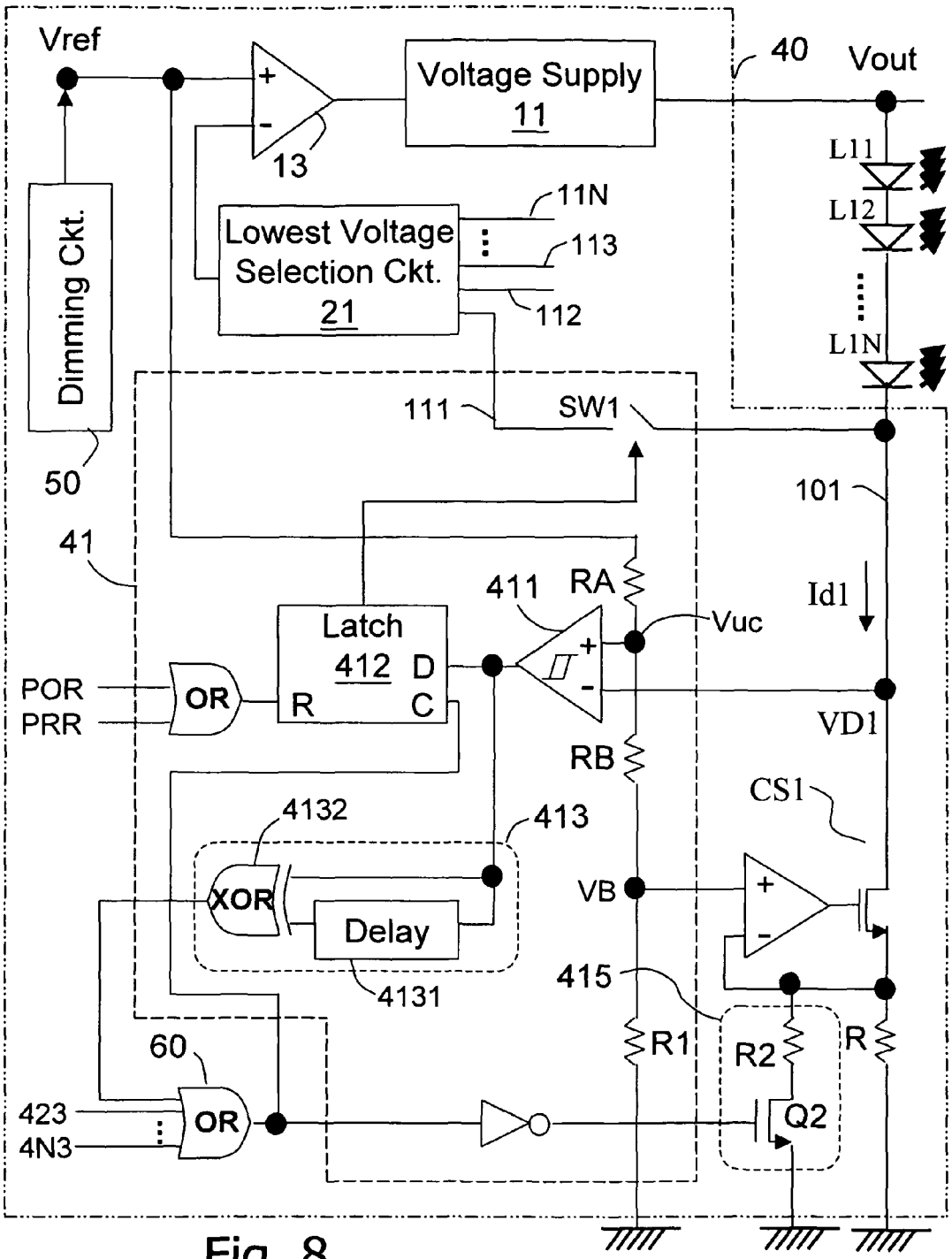
FIG. 8 is a schematic circuit diagram showing yet another embodiment of the present invention.

The embodiments of FIGS. 6 and 7 are only two of the many possible arrangements. Those skilled in this art can think of many variations within the spirit of the present invention. For example, the voltage drop circuit 414 in FIGS. 6 and 7 may be replaced by the voltage drop circuit 415 in FIG. 8, in which the transistor switch Q2 is ON during normal operation, but when the pulse generator 413 generates a pulse, the transistor switch Q2 turns OFF in the short period of the pulse, so that the resistance of the parallel-connection circuit composed of the resistors R and R2 increases. Thus, the current Id1 drops, and the voltage at the node VD1 bounces up (in normal condition), to provide two distinctly different states between normal and abnormal conditions.

By the arrangement of the present invention, the circuit can accurately identify whether each path is operating normally or is inoperative. Therefore, the over voltage protection circuit 12 is not absolutely required; however, it can still be provided for safety.

Although the present invention has been described in considerable detail with reference to certain preferred embodiments, these embodiments are for illustrative purpose and not for limiting the scope of the present invention. Other variations and modifications are possible. For example, in all of the embodiments, one can insert a circuit which does not affect the primary function, such as a delay circuit, between any two devices which are shown to be directly connected. The input level and output level of the digital devices may be arranged in a way different from that shown in the figures; as an example, the XOR gate 4132 in FIG. 7 may be replaced by an XNOR gate, and the logic circuit 60 correspondingly be replaced by a NAND gate. The backlight control circuit is shown to be one integrated circuit, but it can be divided into several integrated circuits, or integrated with other circuit functions. The present invention is not only applicable to series-parallel connection circuits, but also to all-in-parallel and all-in-series circuits. The light emitting devices, although shown as LEDs in the above, are not limited thereto but can be other light emitting devices such as organic light emitting diodes. And the word "backlight" in the term "backlight control circuit" is not to be taken in a narrow sense that the circuit has to control the backlight of a screen; the present invention can be applied to "active light emission display", or "LED illuminator", or other apparatuses that employ light emitting devices. Therefore, all modifications and variations based on the spirit of the present invention should be interpreted to fall within the scope of the following claims and their equivalents.

What is claimed is:

1. A backlight control circuit, comprising:

at least one light emission device path having a voltage node;

at least one current source for controlling a current amount on the light emission device path; and at least one under current detection (UCD) circuit for generating a first control signal according to the voltage on the voltage node to indicate whether the light emission device path is normally connected, wherein when the first control signal changes its state, the UCD circuit generates a second control signal to lower the current amount on the light emission device path such that when the light emission device path is normally connected the voltage at the voltage node is changed, and when the light emission device path is not normally connected the voltage at the voltage node is unchanged, to thereby verify whether the first control signal correctly indicates the connection of the light emission device path.

2. The backlight control circuit of claim 1, wherein the current source includes an error amplifier, and the UCD circuit changes the voltage at the voltage node by adjusting an input voltage of the error amplifier.

3. The backlight control circuit of claim 2, wherein the UCD circuit includes a voltage drop circuit connected in parallel with an input of the error amplifier.

4. The backlight control circuit of claim 3, wherein the voltage drop circuit includes a resistor and a switch controlled by the second control signal.

5. The backlight control circuit of claim 1, wherein the UCD circuit includes a latch to store the first control signal.

6. The backlight control circuit of claim 5, wherein the latch receives the second control signal as its clock signal.

7. The backlight control circuit of claim 5, wherein the latch receives a power ON reset signal or a power recovery reset signal as its reset input.

8. The backlight control circuit of claim 1, further comprising a lowest voltage selection circuit which determines whether to accept the voltage at the voltage node as its input according to the first control signal.

9. The backlight control circuit of claim 1, wherein the UCD circuit includes a comparator which compares the voltage at the voltage node with a first reference voltage to generate the first control signal.

10. The backlight control circuit of claim 9, wherein the comparator is a hysteresis comparator.

11. The backlight control circuit of claim 1, wherein the UCD circuit includes a pulse generator which generates the second control signal according to the first control signal.

12. The backlight control circuit of claim 11, wherein the pulse generator includes a delay circuit and a first logic circuit which generates the second control signal according to the first control signal and the output of the delay circuit.

13. The backlight control circuit of claim 1, wherein the second control signal is a pulse which causes the voltage at the voltage node to vary temporarily.

14. The backlight control circuit of claim 1, comprising at least two light emission device paths and at least two corresponding UCD circuits, wherein when anyone of the UCD circuits generates the second control signal, the voltage at the voltage node of every light emission device path in normal operation varies.

15. The backlight control circuit of claim 1, further comprising a dimming circuit to adjust the brightness of a light emission device in the light emission device path.

16. The backlight control circuit of claim 15, wherein the dimming circuit adjusts a second reference voltage.

17. The backlight control circuit of claim 1, wherein the UCD circuit includes:

a comparator for generating a first control signal according to the voltage at the voltage node;

a latch for storing the first control signal;

a pulse generator for generating the second control signal according to the first control signal; and a voltage drop circuit for controlling the current amount of the current source according to the second control signal.

18. The backlight control circuit of claim 1, wherein when the light emission device path is inoperative, one end of the light emission device path is grounded or left floating.

19. A light emitting device path status detection method, comprising:

(A) providing at least one light emission device path having a voltage node;

(B) generating a first control signal according to the voltage on the voltage node to indicate whether the light emission device path is normally connected; and (C) when the first control signal changes its state, lowering the current amount on the light emission device path such that when the light emission device path is normally connected the voltage at the voltage node is changed, and when the light emission device path is not normally connected the voltage at the voltage node is unchanged, to thereby verify whether the first control signal correctly indicates the connection of the light emission device path.

20. The method of claim 19, further comprising: (D) determining whether or not to use the voltage at the voltage node to control an output of a voltage supply circuit based on the first control signal.

21. The method of claim 19, further comprising: (E) providing a dimming circuit to adjust the brightness of a light emission device in the light emission device path.

22. The method of claim 19, wherein the step (B) includes: (B1) comparing the voltage at the voltage node with a first reference voltage to generate the first control signal.

23. The method of claim 19, wherein the step (B) includes: (B2) latching the first control signal.

24. The method of claim 19, wherein the step (B) includes: (B3) refreshing the first control signal during a power ON stage or a power recovery stage.

25. The method of claim 19, wherein the step (C) includes: (C1) when the first control signal changes its state, generating a second control signal to change the current on the light emission device path if the light emission device path is normally connected.

26. The method of claim 25, wherein the current on the light emission device path is controlled by a current source including an error amplifier, and the second control signal changes the current on the light emission device path by adjusting an input voltage of the error amplifier.

27. The method of claim 25, wherein the step (C1) includes: (C1a) generating a delay signal according to the first control signal, and (C1b) generating a second control signal according to the first control signal and the delay signal.

28. The method of claim 25, wherein the second control signal is a pulse which causes the current on the light emission device path to vary temporarily.

29. The method of claim 19, wherein the step (A) provides at least two light emission device paths and the step (B) generates a corresponding first control signal for each light emission device path, and wherein when anyone of the first control signals changes its state, the current on every light emission device path in normal operation varies.

30. The method of claim 19, further comprising: grounding or leaving floating one end of the light emission device path if it is inoperative.

31. An under current detection (UCD) circuit comprising:

a comparator for generating a control signal by comparing a node voltage on a path with a reference voltage;

a pulse generator for generating a pulse according to the control signal when the control signal changes its state in a first manner and in a second manner;

a verification circuit to verify whether the node voltage is correct by lowering a current through the path in response to the pulse, wherein when the control signal changes its state in the first manner and the node voltage is correct, the node voltage changes in response to lowering the current, and when the control signal changes its state in the second manner and the node voltage is correct, the node voltage remains unchanged in response to lowering the current.

32. The UCD circuit of claim 31, further compromising a latch for storing the control signal.

33. The UCD circuit of claim 31, wherein the pulse generator generates a delay signal according to the control signal, and generates the pulse according to the control signal and the delay signal.

34. The UCD circuit of claim 31, wherein the verification circuit includes a current source which is controlled by the pulse to adjust a current passing through the node.

35. The UCD circuit of claim 34, wherein the current source includes an error amplifier, and wherein the verification circuit includes a voltage drop circuit which is connected in parallel with an input of the error amplifier in the period of the pulse.

* * * * *